US010307315B2

(12) United States Patent
Collura et al.

(10) Patent No.: US 10,307,315 B2
(45) Date of Patent: Jun. 4, 2019

(54) DRIVE ASSEMBLY FOR MANUALLY POWERED WHEELCHAIR AND METHODS OF USING THE SAME

(71) Applicant: The Center for Discovery, Inc., Harris, NY (US)

(72) Inventors: Vincent Collura, Monticello, NY (US); John Damiao, Chestnut Ridge, NY (US); Laura Dancesia, Binghamton, NY (US); Jason Kean, Narrowsburg, NY (US)

(73) Assignee: The Center for Discovery, Inc., Harris, NY (US)

( * ) Notice: Subject to any disclaimer, the term of this patent is extended or adjusted under 35 U.S.C. 154(b) by 0 days.

(21) Appl. No.: 16/156,480

(22) Filed: Oct. 10, 2018

(65) Prior Publication Data

US 2019/0110940 A1 Apr. 18, 2019

Related U.S. Application Data

(60) Provisional application No. 62/571,585, filed on Oct. 12, 2017.

(51) Int. Cl.
*A61G 5/04* (2013.01)
*A61G 5/02* (2006.01)

(52) U.S. Cl.
CPC ..... *A61G 5/047* (2013.01); *A61G 5/022* (2013.01); *A61G 5/027* (2013.01)

(58) Field of Classification Search
CPC ..... A61G 5/047; A61G 5/048; B60K 25/08
See application file for complete search history.

(56) References Cited

U.S. PATENT DOCUMENTS

| | | | |
|---|---|---|---|
| 3,349,862 | A | 10/1967 | Shirley, Jr. |
| 3,351,148 | A | 11/1967 | Solomon |
| 3,688,857 | A | 9/1972 | Miller et al. |
| 4,960,180 | A | 10/1990 | Livingston |
| 5,016,720 | A | 5/1991 | Coker |
| 5,090,513 | A | 2/1992 | Bussinger |

(Continued)

FOREIGN PATENT DOCUMENTS

| | | | |
|---|---|---|---|
| CA | 2402901 | A1 | 3/2004 |
| CA | 2515563 | A1 | 2/2007 |

(Continued)

OTHER PUBLICATIONS

International Search Report and Wirtten Opinion for International Application No. PCT/US2018/055235, dated Mar. 14, 2019, 11 pages.

*Primary Examiner* — Kevin Hurley
(74) *Attorney, Agent, or Firm* — Goodwin Procter LLP

(57) ABSTRACT

A retrofitable drive assembly attaches and detaches quickly, easily, and reversibly from a conventional, manually powered wheelchair and is employed to convert the manually powered wheelchair into an electrically powered wheelchair. The drive assembly includes a plurality of wheel troughs, each adjustably sizeable to receive therein a rear push wheel of the manually powered wheelchair, regardless of the wheelchair's size and its rear push wheels' dimensions. In addition, the drive assembly includes two drive wheels positioned towards a front end of the drive assembly and a single caster-wheel assembly positioned towards a rear end of the drive assembly.

30 Claims, 8 Drawing Sheets

(56) References Cited

U.S. PATENT DOCUMENTS

| | | | | |
|---|---|---|---|---|
| 5,113,959 | A | 5/1992 | Mastov et al. | |
| 5,135,063 | A | 8/1992 | Kropf | |
| 5,186,269 | A | 2/1993 | Avakian et al. | |
| 5,207,286 | A | 5/1993 | McKelvey | |
| 5,234,066 | A | 8/1993 | Ahsing et al. | |
| 5,291,959 | A | 3/1994 | Malblanc | |
| 5,351,774 | A | 10/1994 | Okamoto | |
| 5,421,692 | A | 6/1995 | Varrichio et al. | |
| 5,495,904 | A | 3/1996 | Zwaan et al. | |
| 5,651,422 | A | 7/1997 | Casali | |
| 5,848,658 | A | 12/1998 | Pulver | |
| 6,220,382 | B1 | 4/2001 | Kramer, Jr. et al. | |
| 6,354,390 | B1 | 3/2002 | Uchiyama et al. | |
| 6,371,502 | B1 | 4/2002 | Howlett et al. | |
| 6,547,018 | B1 | 4/2003 | Choi | |
| 6,752,230 | B1 | 6/2004 | Huang | |
| 6,766,871 | B2 * | 7/2004 | Sawyer | A61G 5/047 180/13 |
| 7,815,004 | B1 * | 10/2010 | Watkins | A61G 3/06 180/198 |
| 8,132,637 | B1 * | 3/2012 | Watkins | A61G 3/06 180/198 |
| 8,388,010 | B2 | 3/2013 | Butts et al. | |
| 8,430,189 | B2 | 4/2013 | Tallino | |
| 8,684,113 | B1 | 4/2014 | Laconis | |
| 8,960,352 | B2 * | 2/2015 | Avigad | A61G 5/104 180/198 |
| 9,050,227 | B1 | 6/2015 | Hargroder | |
| 9,358,163 | B1 * | 6/2016 | Studebaker | A61G 5/047 |
| 9,474,665 | B1 | 10/2016 | Chan | |
| 2001/0011613 | A1 | 8/2001 | Schaffner et al. | |
| 2003/0099687 | A1 | 5/2003 | Alitalo et al. | |
| 2005/0236194 | A1 | 10/2005 | Kidd et al. | |
| 2006/0119078 | A1 | 6/2006 | Lim | |
| 2008/0164672 | A1 | 7/2008 | Brown | |
| 2008/0223649 | A1 * | 9/2008 | Wandeler | A61G 3/065 180/333 |
| 2008/0283320 | A1 | 11/2008 | Bowles et al. | |
| 2009/0039612 | A1 | 2/2009 | Bidwell et al. | |
| 2009/0308672 | A1 | 12/2009 | Soldatos | |
| 2010/0036543 | A1 | 2/2010 | Bitzer et al. | |
| 2010/0138128 | A1 | 6/2010 | Strothmann et al. | |
| 2011/0083915 | A1 | 4/2011 | Nelson et al. | |
| 2011/0095508 | A1 | 4/2011 | Chiu | |
| 2011/0101642 | A1 | 5/2011 | Chiu | |
| 2012/0038128 | A1 | 2/2012 | Nimura | |
| 2012/0080243 | A1 | 4/2012 | Mulhern | |
| 2015/0096818 | A1 | 4/2015 | Ewing | |
| 2015/0202101 | A1 | 7/2015 | Louis et al. | |
| 2017/0056259 | A1 | 3/2017 | Olsson | |

FOREIGN PATENT DOCUMENTS

| | | | |
|---|---|---|---|
| CH | 602098 | A5 | 7/1978 |
| EP | 0911011 | A1 | 4/1999 |
| EP | 2033609 | A2 | 9/2009 |
| EP | 2140846 | B1 | 4/2011 |
| EP | 1911428 | B1 | 6/2011 |
| FR | 2926458 | A1 | 7/2009 |
| GB | 2134056 | A | 8/1984 |
| GB | 2274265 | A | 7/1994 |
| GB | 2481404 | A | 12/2011 |
| GB | 2478606 | B | 7/2014 |
| JP | H07196043 | A | 8/1995 |
| JP | 5099772 | B2 | 12/2012 |
| WO | WO-9823239 | A1 | 6/1998 |
| WO | WO-0006416 | A1 | 2/2000 |
| WO | WO-0180803 | A1 | 11/2001 |
| WO | WO-04047707 | A2 | 11/2004 |
| WO | WO-06099587 | A2 | 1/2007 |
| WO | WO-10031895 | A1 | 3/2010 |
| WO | WO-12121568 | A2 | 12/2012 |
| WO | WO-13052778 | A1 | 4/2013 |
| WO | WO-13147601 | A1 | 10/2013 |
| WO | WO-14189189 | A1 | 11/2014 |
| WO | WO-15199334 | A1 | 12/2015 |
| WO | WO-16204668 | A1 | 12/2016 |
| WO | WO-17081475 | A1 | 5/2017 |
| WO | WO-17121588 | A1 | 7/2017 |

* cited by examiner

DRIVE ASSEMBLY FOR MANUALLY POWERED WHEELCHAIR AND METHODS OF USING THE SAME

CROSS-REFERENCE TO RELATED APPLICATION

This application claims priority to and the benefit of, and incorporates herein by reference in its entirety, U.S. Provisional Patent Application No. 62/571,585, which was filed on Oct. 12, 2017.

TECHNICAL FIELD

In various embodiments, the present invention relates to a drive assembly for driving a manually powered wheelchair and to methods of using the drive assembly.

BACKGROUND

Manually powered wheelchairs come in a variety of sizes for a variety of purposes. Two of the most common types of manually powered wheelchairs are the standard folding wheelchair and the non-folding, rigid frame wheelchair. Many individuals with a spinal cord injury from the five cervical vertebrate down to the lumbar vertebrates use a lightweight, rigid frame, manually powered wheelchair for everyday use. The wheelchair is typically powered by the wheelchair user gripping the rims of the rear push wheels and pushing clockwise or counterclockwise for a specified direction and speed. However, there are many situations where using a manually powered wheelchair can be difficult or even unrealistic, such as during lengthy outings, when propelling long distances, when traversing uneven or sloped terrain, and/or when the wheelchair user's deficits are of such a degree that manual propulsion becomes painful, exhausting, or relatively impossible given time or circumstances.

Although electrically powered wheelchairs exist and can be used for those situations, they are generally not prescribed unless the user lacks the ability to use a manually powered wheelchair. Insurance carriers, for example, generally will not pay for a user to have both types of wheelchairs. Moreover, electrically powered wheelchairs tend to be expensive, heavy, and cumbersome.

While power attachments for manually powered wheelchairs exist, they often are not easy to attach and detach from the conventional, manually powered wheelchair. Additionally, many power attachments require modification of the manually powered wheelchair and/or have to be pre-sized to fit a particular manually powered wheelchair's dimensions, such as its height, width, and frame layout, which can vary greatly from one wheelchair manufacturer, or model, or version to the next. Having to add attachment accessories to the manually powered wheelchair and/or having to pre-size the power attachment typically requires tools, time, and/or intervention on the part of the wheelchair user or others that severely limits the convenience of using the power attachment. Moreover, for a child that is confined to a wheelchair, having to replace a pre-sized power attachment each time that the child requires the use of a larger wheelchair as he or she grows can be extremely inconvenient and expensive for the child's parents and/or guardians.

Accordingly, a need exists for an improved power attachment for a manually powered wheelchair.

SUMMARY OF THE INVENTION

In various embodiments, the retrofitable drive assembly described herein attaches and detaches quickly, easily, and reversibly from a conventional, manually powered wheelchair and is employed to convert the manually powered wheelchair into an electrically powered wheelchair. The conversion occurs without the use of tools or wheelchair modification and the drive assembly need not be pre-sized to fit a particular manually powered wheelchair's dimensions. Rather, the size and/or configuration of the drive assembly itself are fully adjustable to accommodate any manually powered wheelchair, regardless of that wheelchair's size and/or configuration. For example, the drive assembly may be adjusted to accommodate different distances between the rear push wheels of different manually powered wheelchairs (e.g., different wheelchair widths), different diameters in the rear push wheels of different manually powered wheelchairs, or both. Accordingly, the retrofitable drive assembly described herein addresses many of the above-mentioned issues that are present in existing power attachments for manually powered wheelchairs and is an improvement over those existing power attachments.

In general, in one aspect, embodiments of the invention feature a drive assembly for driving a manually powered wheelchair. The drive assembly includes wheel troughs extending from a front end towards a rear end of the drive assembly, two drive wheels, and a single caster-wheel assembly. Each wheel trough is adjustably sizeable to receive therein a rear push wheel of a wheelchair. The two drive wheels are positioned towards the front end of the drive assembly and impart motion to the drive assembly, and thereby drive the wheelchair, when the rear push wheels of the wheelchair are positioned within the wheel troughs. The single caster-wheel assembly (which may, for example, include a single caster wheel or, alternatively, multiple caster wheels) is positioned towards the rear end of the drive assembly. Optionally, the drive assembly may also include accessory rollers positioned at the front end of the drive assembly.

Various embodiments of this aspect of the invention include the following features. Each wheel trough may include a ramp (e.g., a spring-loaded ramp) at the front end of the drive assembly. Additionally or alternatively, each wheel trough may include a pin oriented substantially perpendicular to a longitudinal axis of the wheel trough. Optionally, each wheel trough may also include side plates, at least one of which may define a groove sized to permit slideable displacement therein of the pin towards and away from the front end of the drive assembly. In one embodiment, each wheel trough also includes a locking mechanism, disposed on at least one of the side plates, for locking the pin in place. The locking mechanism may include a set of teeth and a cam handle for releaseably engaging one of the teeth. The wheel troughs may thus be adapted to elevate and support (e.g., between the pin and the spring-loaded ramp of each wheel trough) the rear push wheels of the wheelchair above a ground surface.

In one embodiment, the drive assembly includes adjustable cross-tracks that extend between the wheel troughs. Each adjustable cross-track may include at least one T-bar and at least one corresponding sleeve for slideable displacement over the T-bar. The drive assembly may also include a handle to releaseably engage a T-bar and a corresponding sleeve of an adjustable cross-track.

In another embodiment, the drive assembly includes a joystick for controlling the motion of the drive assembly. The drive assembly may also include a joystick arm. The joystick arm may be releaseably mounted, at a first end, in proximity to a rear end of one of the wheel troughs, while the joystick may be coupled to a second, opposite end of the joystick arm.

The drive assembly may also include arms for securing the wheelchair when the rear push wheels of the wheelchair are positioned within the wheel troughs. Each arm may include a hook for engaging a portion of the wheelchair as well as, optionally, a strap for tightening a securement of the wheelchair to the drive assembly and/or a clamp for releaseably engaging the strap.

In general, in another aspect, embodiments of the invention feature a method for driving a manually powered wheelchair having two rear push wheels. In accordance with the method, each rear push wheel of the wheelchair is positioned within a corresponding, adjustably sizeable wheel trough of a drive assembly. Each wheel trough of the drive assembly extends from a front end towards a rear end of the drive assembly. The drive assembly also includes two drive wheels (positioned towards the front end of the drive assembly) and a single caster-wheel assembly (positioned towards the rear end of the drive assembly). The method also includes actuating the two drive wheels to impart motion to the drive assembly and to thereby drive the wheelchair.

Various embodiments of this aspect of the invention include the following features. Prior to positioning each rear push wheel of the wheelchair within the corresponding, adjustably sizeable wheel trough of the drive assembly, a length of each wheel trough may be adjusted to accommodate a diameter of the rear push wheel to be positioned therein and/or a first distance between each wheel trough may be adjusted to accommodate a second distance between the rear push wheels of the wheelchair. Positioning each rear push wheel of the wheelchair within the corresponding, adjustably sizeable wheel trough of the drive assembly may include reversing each rear push wheel of the wheelchair over a ramp of the corresponding wheel trough and/or elevating and supporting the rear push wheels of the wheelchair above a ground surface. The ramp may be positioned at the front end of the drive assembly.

After positioning each rear push wheel of the wheelchair within the corresponding, adjustably sizeable wheel trough of the drive assembly, but before actuating the two drive wheels to impart motion to the drive assembly, the wheelchair may be secured to the drive assembly. The method may also include controlling the motion of the drive assembly through use of a joystick, which may be coupled to a joystick arm of the drive assembly. In one embodiment, the method includes adjusting the joystick arm to accommodate a user of the wheelchair.

These and other features, along with advantages of the embodiments of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. But, for the purposes of clarity, not every component may be labeled in every drawing. Also, the drawings are not necessarily to scale, emphasis instead generally being placed upon illustrating the principles of the invention. In the following description, various embodiments of the present invention are described with reference to the following drawings, in which.

DESCRIPTION

Figure 1:
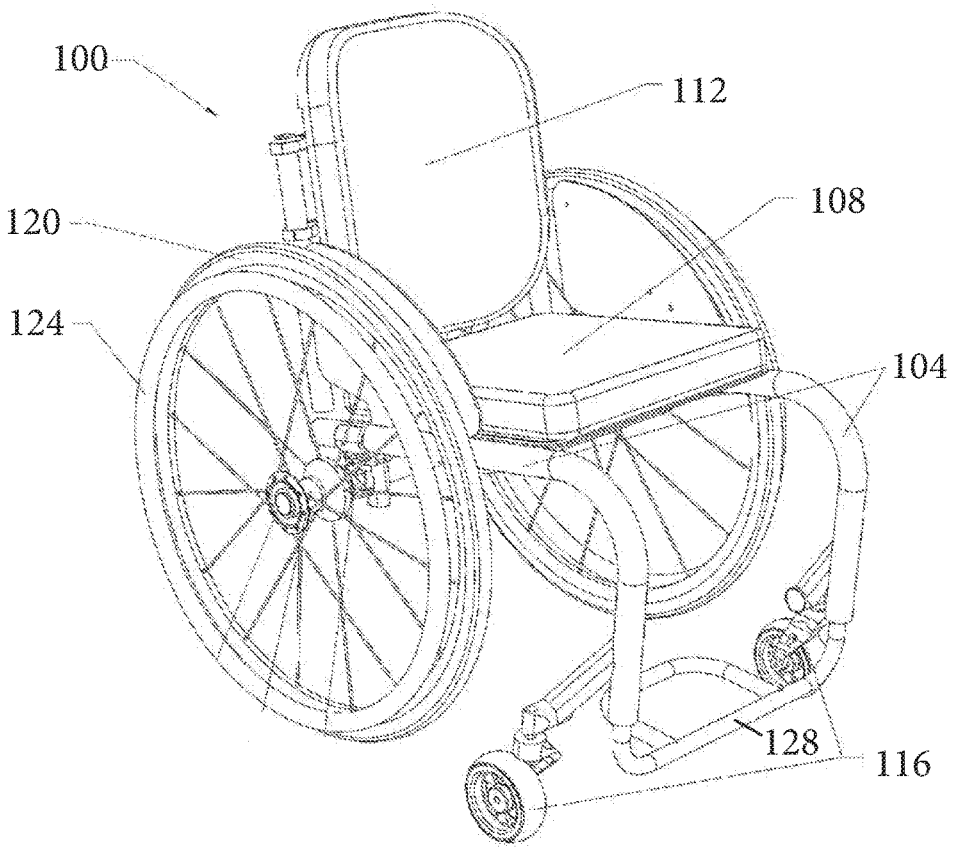
FIG. 1 (Prior Art)
FIG. 1 schematically illustrates one example of a conventional, manually powered wheelchair.

In broad overview, embodiments of the present invention feature a drive assembly for driving a conventional, manually powered wheelchair. FIG. 1 schematically depicts an example of one such conventional, manually powered wheelchair 100. The depicted wheelchair 100 is a non-folding, rigid frame, manually powered wheelchair 100. As shown, the wheelchair 100 includes a frame 104, a seat 108, a backrest 112, two front caster wheels 116, two rear push wheels 120 having push rims 124, and a footrest 128.

Figure 2:
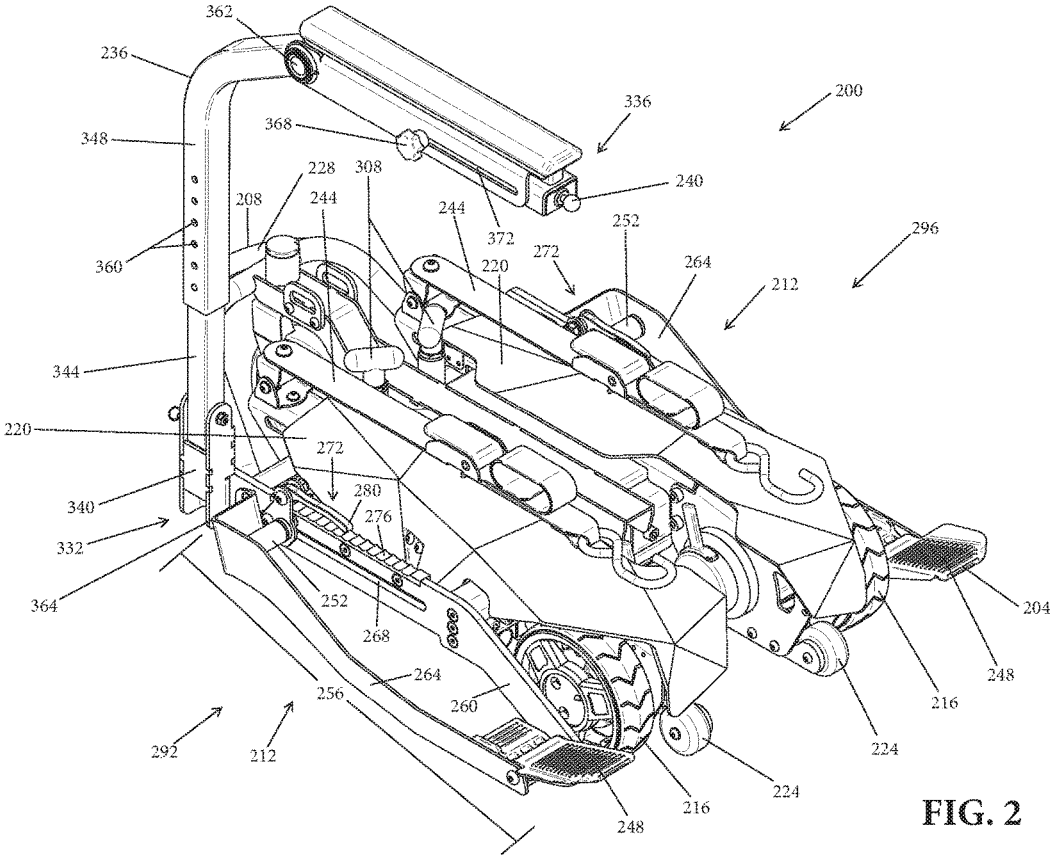
FIG. 2 schematically illustrates a front, left, perspective view of a drive assembly in accordance with one embodiment of the invention.
Figure 3:
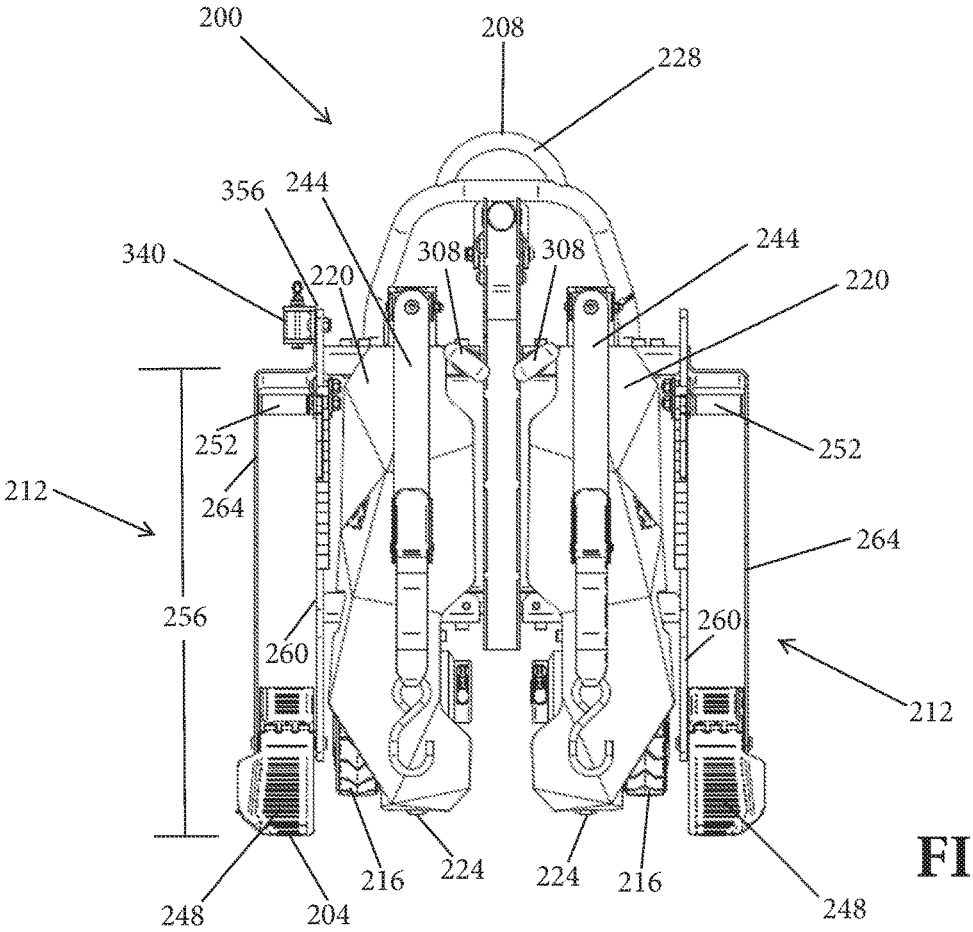
FIG. 3 schematically illustrates a top view of the drive assembly depicted in FIG. 2.

FIG. 2 schematically depicts a front, left, perspective view of a drive assembly 200 for driving a manually powered wheelchair, such as the wheelchair 100, in accordance with one embodiment of the invention, while FIG. 3 schematically depicts a top view of the same drive assembly 200. As shown, the drive assembly 200 is generally symmetrical about a middle plane and includes a front end 204, a rear end 208, and a wheel trough 212 on each of its left and right sides for retaining and supporting the rear push wheels 120 of the manually powered wheelchair 100.

In addition, the drive assembly 200 includes two drive wheels 216, positioned towards the front end 204 of the drive assembly 200. The drive wheels 216 may be actuated by one or more motor(s) (not shown) housed within a casing 220 of the drive assembly 200 to impart motion to the drive assembly 200 and thereby drive the manually powered wheelchair 100 when the rear push wheels 120 of the manually powered wheelchair 100 are positioned within the wheel troughs 212. The casing 220 of the drive assembly 200 may, for example, house two drive motors—one for each drive wheel 216.

As also shown in FIGS. 2 and 3, the drive assembly 200 may include one or more (e.g., two, as depicted) accessory rollers 224 positioned at the front end 204 of the drive assembly 200. The accessory rollers 224 may, for example, facilitate transport of the drive assembly 200, much like the wheels of a rolling suitcase facilitate the transport of the suitcase. In particular, one may grab and lift a handle 228 located at the rear end 208 of the drive assembly 200, such that the drive assembly 200 is elevated at its rear end 208 and is supported on a ground surface at its front end 204 by the accessory wheels 224. When positioned as such, the drive assembly 200 may be pulled across the ground surface to its intended destination. In addition, the accessory rollers 224 may function as an anti-tipping mechanism for the drive assembly 200. In particular, when a load is placed on the front end 204 of the drive assembly 200 (e.g., when the rear push wheels 120 of the manually powered wheelchair 100 are rolled over ramps 248 (discussed further below) of the wheel troughs 212 as the manually powered wheelchair 100 exits the troughs 212), the accessory rollers 224 serve to prevent the drive mechanism 200 from tipping to far forward and over.

Figure 4:
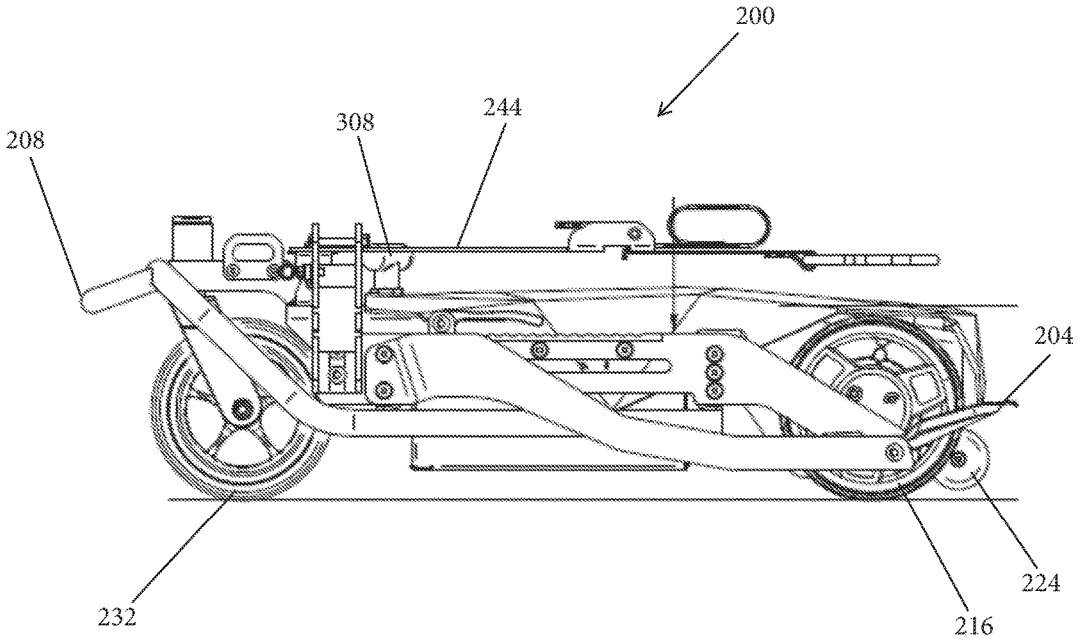
FIG. 4 schematically illustrates a left side view of the drive assembly depicted in FIG. 2.
Figure 5:
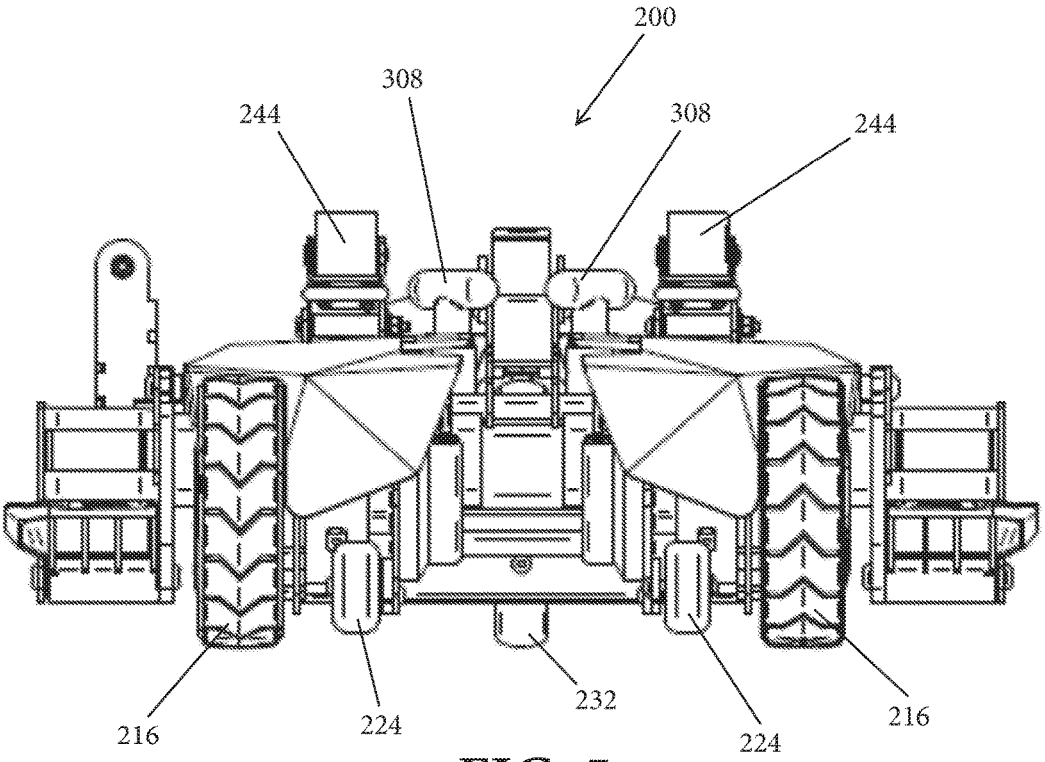
FIG. 5 schematically illustrates a front end view of the drive assembly depicted in FIG. 2.

FIG. 4 schematically depicts a left side view of the same drive assembly 200 that is depicted in FIGS. 2 and 3, while FIG. 5 schematically depicts a front end view of that same drive assembly 200. As best shown in FIG. 4 (and as also visible in FIG. 5), the drive assembly 200 may also include a single caster-wheel assembly 232, which, in one embodiment, is positioned towards the rear end 208 of the drive assembly 200 and facilitates turning of the drive assembly 200 in, for example, a restricted space. The single caster-wheel assembly 232 may include a single caster wheel or, alternatively, multiple caster wheels, as will be understood by one of ordinary skill in the art.

Referring again to FIG. 2, in one embodiment, the drive assembly 200 also includes a joystick arm 236 having, at one end 336 thereof, a mounting ball 240 that couples to a joystick (not shown) that is in turn employed to control the motion of the drive assembly 200. And, with reference to FIGS. 2-5, the drive assembly 200 may also include one or more (e.g., two, as depicted) arms 244 for securing the manually powered wheelchair 100 to the drive assembly 200 when the rear push wheels 120 of the manually powered wheelchair 100 are positioned within the wheel troughs 212 of the drive assembly 200. Both the joystick arm 236 and the securement arms 244 are further described below.

Figure 6:
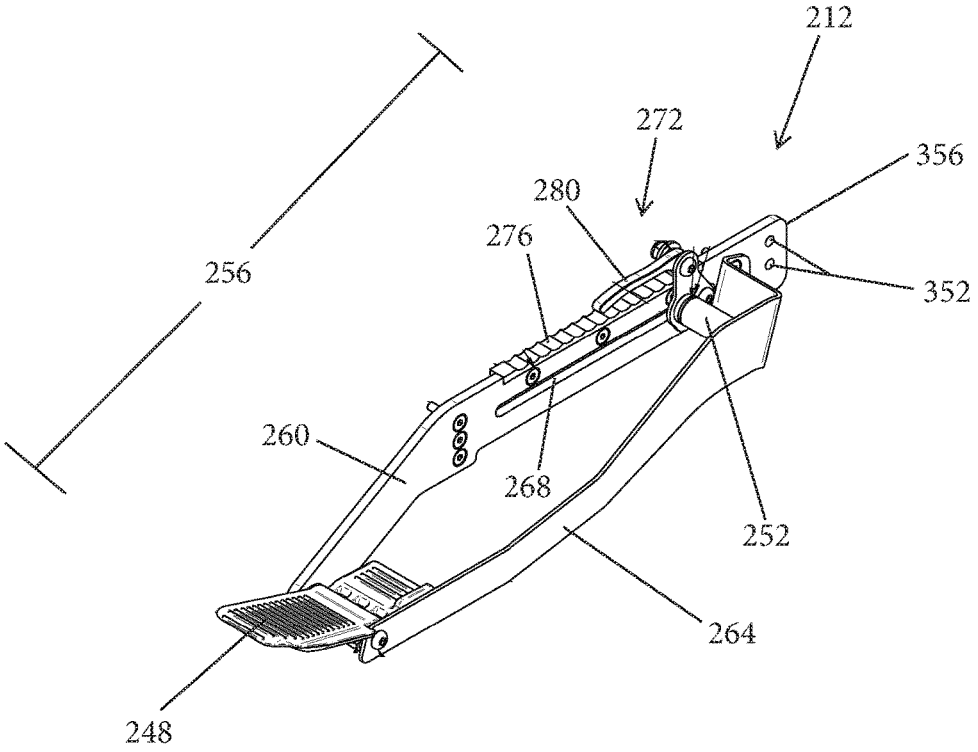
FIG. 6 schematically illustrates a wheel trough of the drive assembly depicted in FIG. 2 in accordance with one embodiment of the invention.

FIG. 6 schematically depicts, in greater detail, one embodiment of the wheel trough 212 for the right side of the drive assembly 200. In one embodiment, the wheel trough 212 for the left side of the drive assembly 200 is a mirror image of the wheel trough 212 for the right side of the drive assembly 200. With reference to FIGS. 2, 3, and 6, in one embodiment, each wheel trough 212 extends from the front end 204 towards the rear end 208 of the drive assembly 200 and includes a ramp 248 (e.g., a spring-loaded ramp 248) at the front end 204 of the drive assembly 200. In addition, each wheel trough 212 includes a pin 252 that is oriented substantially perpendicular to a longitudinal axis 256 of the wheel trough 212, as well as inner and outer side plates 260, 264.

In one embodiment, each wheel trough 212 is adjustably sizeable to receive therein, elevate, and support above a ground surface a rear push wheel 120 of the manually powered wheelchair 100, regardless of the diameter of the rear push wheel 120. For example, in one embodiment, at least one of the side plates 260, 264 defines a groove 268 that is sized to permit slideable displacement therein of the pin 252 towards and away from the front end 204 of the drive assembly 200. As illustrated in FIGS. 2 and 6, in one embodiment it is the inner plate 260 that defines the groove 268 although, in alternative embodiments, it may be the outer plate 264 that defines the groove 268, or both the inner plate 260 and the outer plate 264 that define grooves 268. In any event, moving the pin 252 along the groove 268 towards the front end 204 of the drive assembly 200 decreases a distance between the pin 252 and the ramp 248, thereby adjusting the wheel trough 212 to accommodate a smaller diameter wheel 120. Conversely, moving the pin 252 along the groove 268 away from the front end 204 of the drive assembly 200 and towards the rear end 208 of the drive assembly 200 increases a distance between the pin 252 and the ramp 248, thereby adjusting the wheel trough 212 to accommodate a larger diameter wheel 120. In one embodiment, the wheel trough 212 is adjustable to accommodate rear push wheels 120 of any size, for example rear push wheels 120 of 10 inches in diameter to 26 inches in diameter. Together, in use, the ramp 248 and pin 252 of each wheel trough 212 elevate and support a rear push wheel 120 of the manually powered wheelchair 100 above a ground surface when the rear push wheel 120 is placed within the wheel trough 212.

To facilitate the movement and placement of the pin 252, the wheel trough 212 may include, as best illustrated in FIGS. 2 and 6, a locking mechanism 272 for locking the pin 252 in place. In one embodiment, the locking mechanism 272 is disposed on at least one of the side plates 260, 264. For example, like the groove 268, the locking mechanism 272 may be disposed on the inner plate 260, on the outer plate 264, or on both the inner plate 260 and the outer plate 264. In the exemplary embodiment illustrated in FIGS. 2 and 6, the locking mechanism 272 is disposed on the inner plate 260. In one embodiment, as illustrated, the locking mechanism 272 includes a set of teeth 276 and a cam handle 280 for releaseably engaging one of the teeth 276. By lifting the cam handle 280, the cam handle 280 is unlocked and disengaged from the teeth 276 of the locking mechanism 272, which permits the pin 252 to be advanced or retracted (i.e., forward or backward) along the groove 268. Once the pin 252 is positioned so that the rear push wheel 120 of the manually powered wheelchair 100 properly fits between and is elevated and supported by the ramp 248 and the pin 252 (i.e., so the rear push wheel 120 will not contact the ground surface when loaded), the cam handle 280 may be lowered to once again engage and lock the teeth 276 of the locking mechanism 272.

Figure 7:
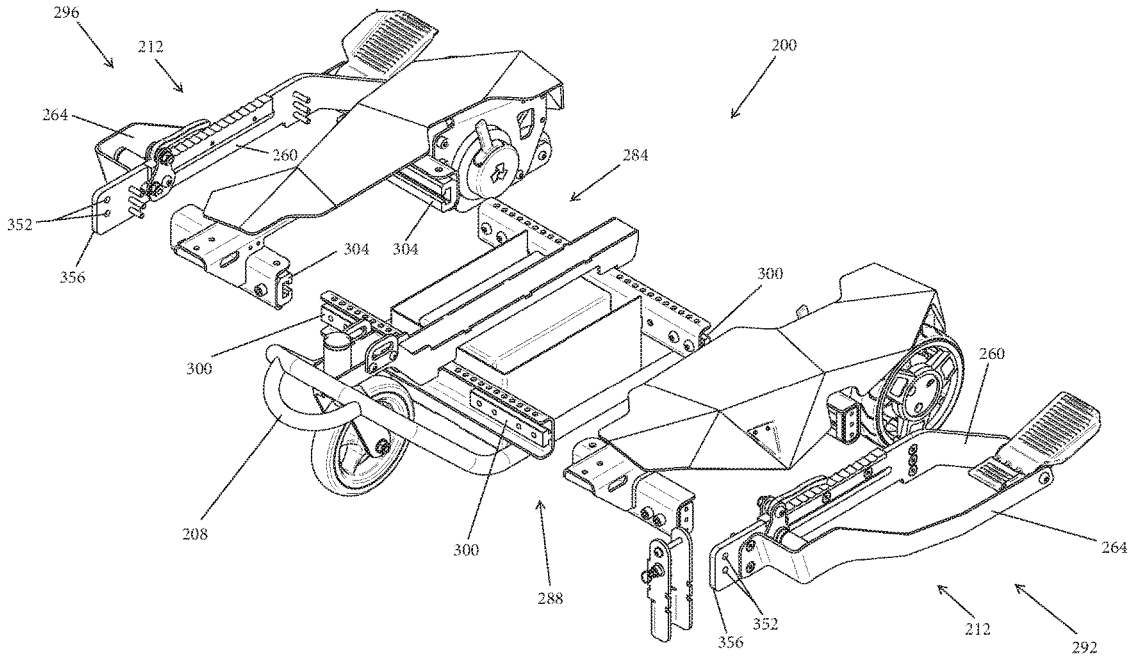
FIG. 7 schematically illustrates an exploded component view of various components of the drive assembly depicted in FIG. 2 in accordance with one embodiment of the invention.

While, as just described, the drive assembly 200 may be adjustable to accommodate different diameters in the rear push wheels 120 of different manually powered wheelchairs 100, the drive assembly 200 can also, in certain embodiments, be adjustable to accommodate different wheelchair 100 widths—e.g., different distances between the rear push wheels 120. FIG. 7, for example, schematically depicts an exploded component view of various components of the drive assembly 200 described above. As shown, the drive assembly 200 may include one or more adjustable cross-tracks (e.g., front and rear adjustable cross-tracks 284, 288, as illustrated) that extend between the wheel troughs 212 and that couple components from the left side 292 of the drive assembly 200 to components from the right side 296 of the drive assembly 200. In one embodiment, each adjustable cross-track 284, 288 includes at least one T-bar 300 and at least one corresponding sleeve 304 for slideable displacement over the T-bar 300. With reference to FIGS. 2-5, the drive assembly 200 may also include one or more handles (e.g., pull-pins) 308. For example, the drive assembly 200 may include two handles 308 for the adjustable cross-track 288 that is positioned most closely towards the rear end 208 of the drive assembly 200 (see, FIG. 7). In one embodiment, each handle 308 releaseably engages (e.g., locks and unlocks) a T-bar 300 and a corresponding sleeve 304 of the rear adjustable cross-track 288. In one implementation, as depicted, handles are not employed in connection with the front cross-track 284. As such, the T-bars 300 and corresponding sleeves 304 of the front cross-track 284 are continuously unlocked from one another.

In operation, the illustrated handles 308 may be turned and lifted to disengage the handles 308 from the T-bars 300 and sleeves 304 of the rear cross-track 288. In this unlocked state, the sleeves 304 of both the front cross-track 284 and the rear cross-track 288 may be slideably displaced over their respective T-bars 300 in order to adjust the distance between the left 292 and right 296 sides of the drive assembly 200 (i.e., the distance or width between the two illustrated wheel troughs 212). In particular, the distance or width between the two illustrated wheel troughs 212 may be either increased or decreased to accommodate a manually powered wheelchair 100 having either a larger or smaller distance or width between its two rear push wheels 120. Once the distance between the two illustrated wheel troughs 212 is adjusted to match the distance between the rear push wheels 120 of the manually powered wheelchair 100, the handles 308 may be lowered and turned in the opposite direction to re-engage the rear cross-track 288 joining the left 292 and right 296 sides of the drive assembly 200. In this locked state, the sleeves 304 of both the front cross-track 284 and the rear cross-track 288 are prevented from being slideably displaced over their respective T-bars 300. In one embodiment, the distance or width between the two wheel troughs 212 is adjustable between 16 inches and 26 inches to accommodate manually powered wheelchairs 100 of different sizes.

In one embodiment, once the wheel troughs 212 have been adjusted to fit both the diameter of and the width between the rear push wheels 120 of the manually powered wheelchair 100 to be placed therein (using the locking mechanisms 272 and adjustable cross-tracks 284, 288, respectively), the wheelchair 100 is reversed over the spring-loaded ramps 248 of the wheel troughs 212, until the wheelchair's rear push wheels 120 fall into the wheel troughs 212 between the side plates 260, 264 and abut the pins 252. While, with the rear push wheels 120 so positioned, the wheel troughs 212 elevate and support the rear push wheels 120 above a ground surface, the securement arms 244 of the drive assembly 200 (see, FIGS. 2-5) may nevertheless be employed, in one embodiment, to secure the manually powered wheelchair 100 to the drive assembly 200.

Figure 8:
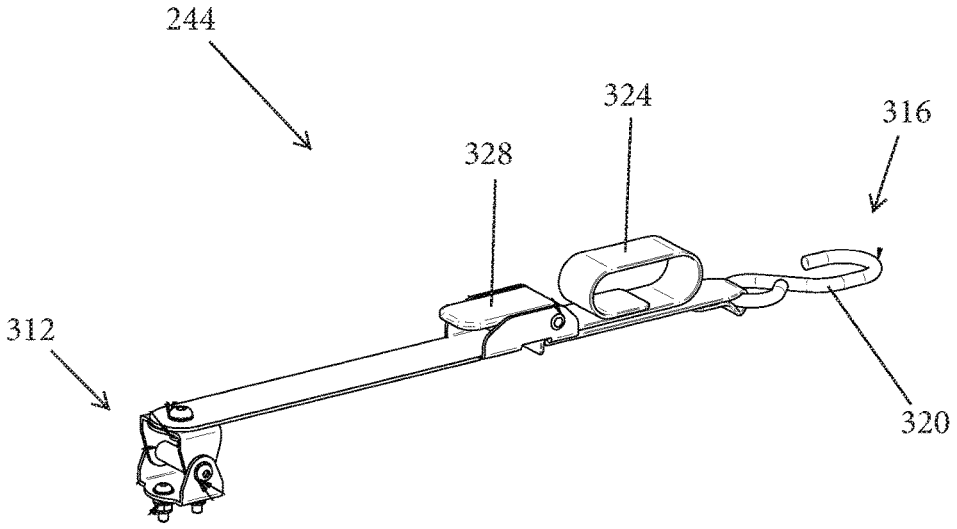
FIG. 8 schematically illustrates an arm of the drive assembly depicted in FIG. 2 for securing a manually powered wheelchair to the drive assembly in accordance with one embodiment of the invention.

FIG. 8 schematically depicts one embodiment of a securement arm 244 of the drive assembly 200. As shown, the securement arm 244 extends between a proximal end 312, at which the arm 244 is coupled to the drive assembly 200 (e.g., using one or more fastening mechanisms, such as nuts and bolts), and a distal end 316, at which the arm 244 includes components for engaging a portion of the manually powered wheelchair 100. In particular, in the illustrated embodiment, the securement arm 244 includes a hook 320 towards its distal end 316. The hook 320 may, for example, be hooked to a rear portion of the frame 104 of the manually powered wheelchair 100 (see, FIG. 1). In addition, the securement arm 244 may include strap 324 and/or a clamp 328 proximate its distal end 316. In one embodiment, once the hook 320 is hooked to the rear portion of the frame 104 of the manually powered wheelchair 100, the strap 324 and/or clamp 328 (which releaseably engages the strap 324) are employed to tighten a securement of the manually powered wheelchair 100 to the drive assembly 200. In particular, with the handle of the clamp 328 elevated to disengage the clamp 328 from the strap 324, an individual assisting a user of the manually powered wheelchair 100 may pull on the strap 324 to tighten the securement of the manually powered wheelchair 100 to the drive assembly 200 (i.e., to remove slack in the strap 324). Then, once the slack in the strap 324 is removed to a satisfactory amount, the handle of the clamp 328 may be lowered so that the clamp 328 re-engages and locks the strap 324 in place, thereby securing the manually powered wheelchair 100 to the drive assembly 200.

With reference back to FIG. 2, in one embodiment, as previously mentioned, the drive assembly 200 also includes a joystick arm 236 having a first end 332 and a second, opposite end 336. In one embodiment, the joystick arm 236 includes a mount 340, a mounting tube 344, and a main arm 348. As shown in FIGS. 6 and 7, through holes 352 may be defined through the inner side plate 260 of each wheel trough 212 at a rear end 356 of the side plate 260. Accordingly, as best shown in FIG. 3, the mount 340 may be removeably fastened, for example using nuts and bolts or other removeable fastening mechanisms that extend through the through holes 352, to the rear end 356 of either one of the slide plates 260.

Referring again to FIG. 2, the mounting tube 344 may be inserted into the mount 340 and be removeably fastened thereto, for example again using nuts and bolts or other fastening mechanisms. For its part, the main arm 348 is slideable over the mounting tube 344. The mounting tube 344 may, for example, include on its exterior surface a push pin that is biased to project outwards from the exterior surface, but that may be pushed in to be flush with the exterior surface in order to slide the main arm 348 thereover. Though holes 360, corresponding in size to the push pin of the mounting tube 344, may be present along a hollow length of the main arm 348. Accordingly, in one embodiment, the push pin of the mounting tube 344 is pushed in in order to permit slideable movement of the main arm 348 over the mounting tube 344, and remains pushed in until a desired one of the through holes 360 is aligned with the push pin. The push pin, in accordance with its bias, then returns to the state in which it projects outwards from the exterior surface of the mounting tube 344 (i.e., through a through hole 360), thereby locking the mounting tube 344 and main arm 348 together. In this way, because the main arm 348 includes multiple through holes 360 along its length, the height of the joystick arm 236 may be adjusted to accommodate a user of the drive assembly 200.

In addition, the main arm 348 of the joystick arm 236 may include a release button 362. When the release button 362 is pressed inwards, the portion of the main arm 348 extending between the release button 362 and the end 336 may have its pitch adjusted to accommodate a user of the drive assembly 200. For example, with the release button 362 pressed inwards, that portion of the main arm 348 may be rotated counterclockwise (e.g., so that it is flipped straight up) or clockwise (e.g., so that it is flipped straight down).

As illustrated in FIG. 2, the joystick arm 236 may be releaseably mounted, at its first end 332, in proximity to a rear end 364 of one of the wheel troughs 212. For a right-handed user of the manually powered wheelchair 100, the joystick arm 236 may be mounted, as shown, on the left side 292 of the drive assembly 200. Alternatively, the removeable fastening mechanism securing the mount 340 to the rear end 356 of the side plate 260 located on the left side 292 of the drive assembly 200 may be removed and the mount 340 attached to the rear end 356 of the slide plate 260 located on the right side 296 of the drive assembly 200, so that the joystick (not shown) of the joystick arm 236 may be employed by a left-handed user of the manually powered wheelchair 100.

As shown in FIG. 2, in one embodiment, a mounting ball 240 is present at the second end 336 of the joystick arm 236. In one such embodiment, a joystick (not shown) is coupled to the mounting ball 240 and movement of the joystick controls movement of the drive assembly 200. Data representing the movement of the joystick may, for example, be communicated wirelessly to electronics housed within the casing 220 of the drive assembly 200, which may then control the one or more motor(s) that actuate the drive wheels 216. Alternatively, a hard wire connection may run through the joystick arm 236, so that it may couple to a port in the casing 220 that is in communication with the electronics controlling the one or more motor(s).

In one embodiment, a knob 368 present on the main arm 348 of the joystick arm 236 controls how far from or close to the front end 204 of the drive assembly 200 the joystick is located. In particular, the knob 368 may be loosened and slid through a groove 372 of the main arm 348 to permit displacement of the joystick towards or away from the front end 204 of the drive assembly 200. When the joystick reaches its desired position, the knob 368 may be tightened to lock the joystick in place. Accordingly, in this way as well, the joystick arm 236 may be adjusted to accommodate a user of the manually powered wheelchair 100.

In one embodiment, the drive assembly 200 described herein weighs less than 35 pounds, but is able to support use by an individual user who weighs up to 250 pounds. The drive assembly 200 may have, in the absence of the joystick arm 236, a height of less than 6.5 inches.

Exemplary Method of Use

In operation, when the drive assembly 200 is to be used in connection with a particular manually powered wheelchair 100 of given size and dimensions, the length of each wheel trough 212 may be adjusted (as described above) to accommodate the diameter of the rear push wheel 120 to be positioned therein and the distance (e.g., width) between each wheel trough 212 may be adjusted (as described above) to accommodate a distance (e.g., width) between the rear push wheels 120 of the manually powered wheelchair 100. Then, each rear push wheel 120 of the manually powered wheelchair 100 may be reversed over the ramp 248 of a wheel trough 212 to position each rear push wheel 120 within its respective wheel trough 212. As described above, in this state, the ramp 248 and pin 252 of each wheel trough 212 together act to elevate and support the rear push wheel 120 positioned therein above the ground surface. In addition, as also described above, with the manually powered wheelchair 100 positioned in this state, the wheelchair 100 may be secured to the drive assembly 200, for example by using the hooks 320, straps 324, and/or clamps 328 of the securement arms 244. A user of the wheelchair 100 may then use the joystick (optionally, after the joystick arm 236 has been positioned to accommodate the user of the wheelchair 100) to control the motion of the drive assembly 200. In particular, as described above, movement of the joystick actuates the two drive wheels 216 of the drive assembly 200 to impart motion to the drive assembly 200, thereby driving the otherwise manually powered wheelchair 100.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A drive assembly for driving a manually powered wheelchair, comprising:

a plurality of wheel troughs extending from a front end towards a rear end of the drive assembly, each wheel trough (i) adjustably sizeable to receive therein a rear push wheel of a wheelchair and (ii) comprising a ramp at the front end of the drive assembly;

two drive wheels, positioned towards the front end of the drive assembly, for imparting motion to the drive assembly and thereby driving the wheelchair when the rear push wheels of the wheelchair are positioned within the wheel troughs; and a single caster-wheel assembly, positioned towards the rear end of the drive assembly.

2. The drive assembly of claim 1, wherein the ramp of each wheel trough is spring-loaded.

3. The drive assembly of claim 1, wherein the plurality of wheel troughs are adapted to elevate and support the rear push wheels of the wheelchair above a ground surface.

4. The drive assembly of claim 1 further comprising a plurality of adjustable cross-tracks extending between the wheel troughs.

5. The drive assembly of claim 4, wherein each adjustable cross-track comprises at least one T-bar and at least one corresponding sleeve for slideable displacement over the T-bar.

6. The drive assembly of claim 5 further comprising at least one handle for releaseably engaging the at least one T-bar and the at least one corresponding sleeve of at least one of the adjustable cross-tracks.

7. The drive assembly of claim 1 further comprising a joystick arm releaseably mounted, at a first end, in proximity to a rear end of one of the wheel troughs.

8. The drive assembly of claim 7, wherein the joystick arm further comprises, at a second, opposite end, a mounting ball.

9. The drive assembly of claim 7, wherein the joystick arm is adjustable.

10. The drive assembly of claim 1 further comprising a plurality of arms for securing the wheelchair when the rear push wheels of the wheelchair are positioned within the wheel troughs.

11. The drive assembly of claim 10, wherein each arm comprises a hook for engaging a portion of the wheelchair.

12. The drive assembly of claim 10, wherein each arm comprises a strap for tightening a securement of the wheelchair to the drive assembly.

13. The drive assembly of claim 12, wherein each arm comprises a clamp for releaseably engaging the strap.

14. The drive assembly of claim 1, wherein the single caster-wheel assembly comprises a single caster wheel.

15. The drive assembly of claim 1 further comprising a plurality of accessory rollers positioned at the front end of the drive assembly.

16. A drive assembly for driving a manually powered wheelchair, comprising:

a plurality of wheel troughs extending from a front end towards a rear end of the drive assembly, each wheel trough (i) adjustably sizeable to receive therein a rear push wheel of a wheelchair and (ii) comprising a pin oriented substantially perpendicular to a longitudinal axis of the wheel trough;

two drive wheels, positioned towards the front end of the drive assembly, for imparting motion to the drive assembly and thereby driving the wheelchair when the rear push wheels of the wheelchair are positioned within the wheel troughs; and a single caster-wheel assembly, positioned towards the rear end of the drive assembly.

17. The drive assembly of claim 16, wherein each wheel trough comprises a plurality of side plates.

18. The drive assembly of claim 17, wherein at least one of the side plates defines a groove sized to permit slideable displacement therein of the pin towards and away from the front end of the drive assembly.

19. The drive assembly of claim 17, wherein each wheel trough comprises a locking mechanism, disposed on at least one of the side plates, for locking the pin in place.

20. The drive assembly of claim 19, wherein the locking mechanism comprises a set of teeth and a cam handle for releaseably engaging one of the teeth.

21. A method for driving a manually powered wheelchair having two rear push wheels, the method comprising the steps of:

(i) positioning each rear push wheel of the wheelchair within a corresponding, adjustably sizeable wheel trough of a drive assembly by reversing each rear push wheel of the wheelchair over a ramp of its corresponding wheel trough, each wheel trough extending from a front end towards a rear end of the drive assembly and the ramp of each wheel trough being positioned at the front end of the drive assembly, the drive assembly further comprising:

two drive wheels, positioned towards the front end of the drive assembly; and a single caster-wheel assembly, positioned towards the rear end of the drive assembly; and (ii) actuating the two drive wheels to impart motion to the drive assembly and to thereby drive the wheelchair.

22. The method of claim 21 further comprising, prior to performing step (i), adjusting a length of each wheel trough to accommodate a diameter of the rear push wheel to be positioned therein.

23. The method of claim 21 further comprising, prior to performing step (i), adjusting a first distance between each wheel trough to accommodate a second distance between the rear push wheels of the wheelchair.

24. The method of claim 21, wherein step (i) comprises elevating and supporting the rear push wheels of the wheelchair above a ground surface.

25. The method of claim 21 further comprising, following performance of step (i) and prior to performing step (ii), securing the wheelchair to the drive assembly.

26. The method of claim 21 further comprising controlling the motion of the drive assembly.

27. The method of claim 21, wherein the drive assembly further comprises a joystick arm releaseably mounted, at a first end, in proximity to a rear end of one of the wheel troughs.

28. The method of claim 27 further comprising adjusting the joystick arm to accommodate a user of the wheelchair.

29. The method of claim 21, wherein the ramp of each wheel trough is spring-loaded.

30. The method of claim 21, wherein the single caster-wheel assembly comprises a single caster wheel.

* * * * *